US005310994A

United States Patent [19]

Thabet et al.

[11] Patent Number: 5,310,994

[45] Date of Patent: May 10, 1994

[54] FERTILITY PERIOD CALCULATOR

[75] Inventors: Raymond Thabet, Saint-Jacques; Louis Cliche, Sainte Foy, both of Canada

[73] Assignee: Carole M. Mercier, Nun's Island, Canada

[21] Appl. No.: 863,671

[22] Filed: Apr. 1, 1992

[51] Int. Cl.[5] ..... G06C 27/00; G06C 3/00

[52] U.S. Cl. ..... 235/77; 235/78 RC; 235/88 RC

[58] Field of Search ..... 235/78 RC, 83, 85 FC, 235/88 RC

[56] References Cited

U.S. PATENT DOCUMENTS

| | | | |
|---|---|---|---|
| 2,725,195 | 11/1955 | Rueff | 235/88 RC |
| 3,215,344 | 11/1965 | Joffe | 235/78 RC |
| 3,278,118 | 10/1966 | Klein, Jr. | 235/88 RC |
| 3,486,691 | 12/1969 | Rodriguez | 235/88 RC |

*Primary Examiner*—Michael L. Gellner
*Assistant Examiner*—Eddie C. Lee
*Attorney, Agent, or Firm*—Malin, Haley, DiMaggio & Crosby

[57] ABSTRACT

A fertility period calculator especially suited for third world countries, non-complex in operation, having two rotatable disks that require identification of numerals representing the days of the month and the average number of days in the user's menstrual cycle.

2 Claims, 2 Drawing Sheets

FERTILITY PERIOD CALCULATOR

BACKGROUND OF THE INVENTION

1. Field of the Invention

This invention relates to a fertility period calculator and specifically to an improved fertility calculator especially useful in third world countries to determine, through the natural menstrual cycle of a woman, those particular days when a woman is most likely not to conceive a child. The device is simplified for use by women who might otherwise have difficulty in comprehending and manipulating a complicated device.

2. Description of the Prior Art

Fertility period calculators are well known in the prior art. U.S. Pat. No. 4,092,521, issued to Weisshaar, May 30, 1978, shows a multiple disk device that is used to calculate the menstrual cycle. Because of the numerous disks and written materials on the device it is complicated to determine the specific available days when conception is not likely. U.S. Pat. No. 4,367,527, issued to Desjacques, Jan. 4, 1983, shows an electronic calculator including memory that is quite complex and would be difficult for many people in the third world to utilize effectively. Another fertility calculator is shown in U.S. Pat. No. 4,625,099, issued to Freedom, Nov. 25, 1986 which contains much written data and disk-like rotatable members which require a thorough knowledge of written language for proper utilization. U.S. Pat. No. 4,737,619, issued to Freedom, Apr. 12, 1988, shows a handheld calculator having only two disks but still requires reading of written indicia for complete understanding and utilization of the device. Finally, U.S. Pat. No. 3,964,674, issued to Van der Gahst, Jun. 22, 1976, shows a very complex calculator with multiple disks and much indicia which may be difficult for persons with limited education to utilize effectively.

Another important factor in the utilization of fertility period calculators is their universal distribution in numerous countries having different languages. The present invention provides a very simple mechanical fertility period calculator that requires only two manipulations and uses universal symbols to aid the user without requiring complex written indicia instructions for its operation. The device is also mounted in a protective compact housing which can be carried and stored safely and conveniently.

SUMMARY OF THE INVENTION

A handheld mechanical fertility period calculator comprising a compact carrying case, a floor on said case including a circular recess having numerical indicia representative of the numerical days of the month disposed around its perimeter and a pair of rotatable interior disks mounted in said recess, the first of which provides for mechanical manipulation for identifying the first day of menstruation on the calendar scale and a second manipulative disk to identify numerically the average length of the users menstrual period. A curved extending portion on the second disk blocks out those days of the month displayed around the recess on the floor which are not available for intercourse when the user is most likely to conceive. The curved indicia blocking portion includes universal symbols for babies and a pair of arrows showing the start and stop dates available for intercourse.

The device is quite simple to use and does not require a literate person for its activation but merely a person that can identify numerals. To operate the device, the user moves a pair of radially projecting day guides connected to a manually actuated handle on one disk. The day guides include red indicia markings to highlight the day guides. The user selects between the day guide a particular day of the month which represents the first day of the user's menstrual cycle in the month. The second disk is manually actuated (rotated) by a pair of finger engaging projections to move a display window that also shows individually a series of numerals (from 22 to 39) providing a number to equal the average days of the user's menstrual cycle. Once these two simple movements are accomplished using only two numbers, the user then can quickly determine those days of a particular month when intercourse can be had without fear of pregnancy.

The compact carrying case is comprised of a pair of flat surfaces joined by a hinge member with raised borders around to encompass the operative elements of the device. One inside wall member is selected and has a floor recess that receives the other disk components as described herein. As stated above, a circular recess disposed in one floor of the carrying case has radially disposed indicia, displaying thirty-one equal radial spaces each containing a number representative of the days of the month, from one through thirty-one.

The first movable member that is mounted in the recess in the carrying case floor is a thin plastic circular disk having raised central portions forming a manipulating handle with a center indicia line. A pair of radial side-by-side protruding guides are fixed to the disk at one circumferential position and are aligned with the indicia on the handle. The protruding guides are painted a distinctive color that matches the line along the manipulating handle for alignment. The first disk is mounted in the recess and is movable therein. The two protrudinq guides are sized to encompass one numeral representing a day of the month displayed on the flat plane of the carrying case floor. Also printed on the first disk are a sequence of individual numbers from 22 through 39 equally spaced that represent the average number of days in the user's menstrual period. These are disposed in a strategic area for alignment with a window in the second disk that is placed over the circular inner disk.

A second rotatable disk member, having a large central aperture, is mounted on top of the first disk where it fits so that the second (outer) disk is rotatably slidable relative to the first (inner) disk. The second outer disk includes a window in a strategic location in registration with the numbers placed on the first inner disk, showing only one number at a time, which represents the average number of days in the user's menstrual period. Also the upper disk includes an circumferentially extended arc-shaped portion that is sized and aligned so that when the second outer disk is mounted on the second (inner) circular disk, a portion of the calendar day numerals displayed on the flat plane are blocked out. This arc-shaped blocking portion includes universal symbols that represent babies and end indicia shaped like arrows.

To operate the device, the inner disk with its handle including a red line for alignment in conjunction with two red guide members is then placed on the first day of the menstruation period of the user numerically. Once the first day of the menstrual cycle has been selected, based on the calendar day, the upper disk is manually moved so that the window showing numbers is moved until the number selected represents the average number of days in the woman's menstrual cycle. The answer is then complete and those days of the month (numbers) of maximum fertility will be automatically obscured from view of the user by virtue of the overlapping arc portions showing the babies. Intercourse should only take place on the calendar days observable on the device. It is believed that because of the simplistic operation of this device that the teaching and utilization of the device by women in third world countries can be quickly done.

The value of the device is that many cultures do not religiously permit chemical or mechanical birth control devices to be used. Also in many third world countries even if their culture permits their use, the chemical and mechanical devices are not always available. With the present invention it is believed that the birth control rate, especially in third world countries, can be dramatically controlled through the use of the natural cycle of a woman's menstrual period and fertility period in a device that is so relatively easy to use and understand that virtually anyone of any literacy level can readily learn to use the device. By providing a compact and protective case it will prevent the device from accidentally being changed which could affect the results over a period of one month. The device, once set for the month, can be referenced throughout the month and then safely stored for the next reference.

It is an object of this invention to provide an improved fertility period calculator in which third world users will quickly learn to use the device and do not require a high level of literacy in order to utilize the device.

It is another object of this invention to provide an improved fertility period calculator that is quite simple in construction and even more simple in its operation.

Yet still another object of this invention is to provide a low cost fertility calculator that can be provided on a mass volume scale to millions of users, especially in third world countries, in a cost effective way greatly reducing demands on other costly forms of birth control when done on a large scale.

In accordance with these and other objects which will be apparent hereinafter, the instant invention will now be described with particular reference to the accompanying drawings.

PREFERRED EMBODIMENT OF THE INVENTION

Figure 1:
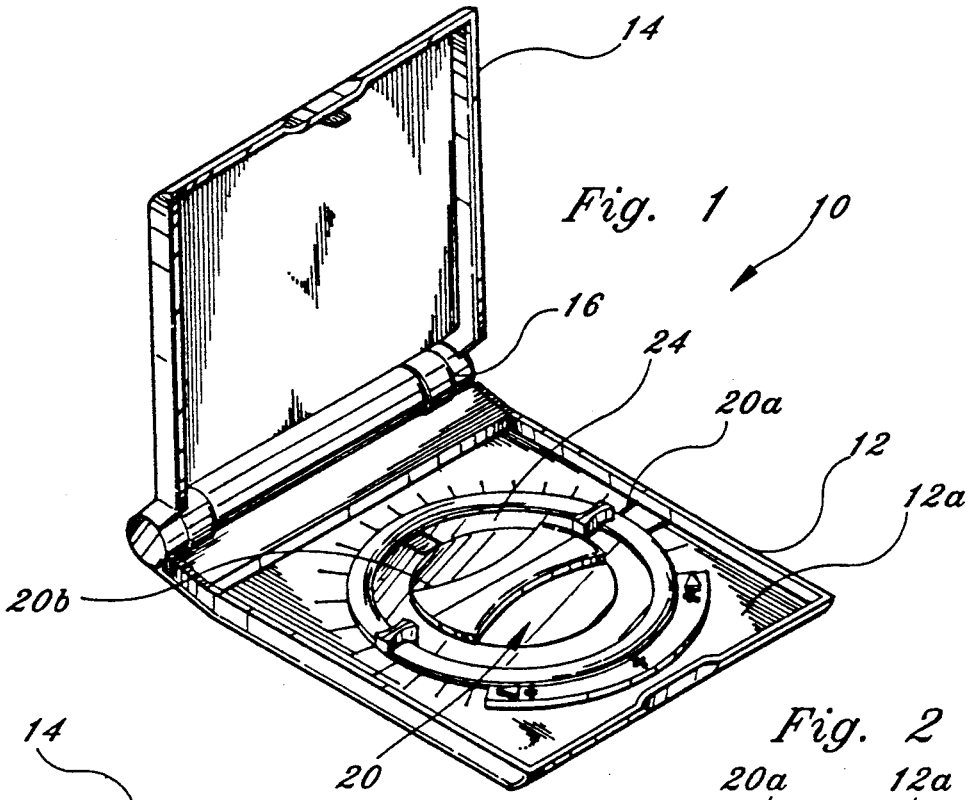
FIG. 1 is the perspective view of the present invention.

Referring now to the drawings and especially FIG. 1, the present invention is shown at 10 and includes a carrying case having a surface 12 and a surface 14 joined by conventional hinge 16 so that the surface 14 can be closed firmly against surface 12. Surface 12 also includes a flat planar floor 12*a* having a circular recess (not shown in FIG. 1) that receives inner circular disk 20 and outer disk 24. Disk 20 is attached to indicators 20*a* mechanically as will be described hereinafter. The outer disk 24 can be rotated and rotatably attached to disk 20 which itself is rotatably attached to the floor 12*a*.

Figure 2:
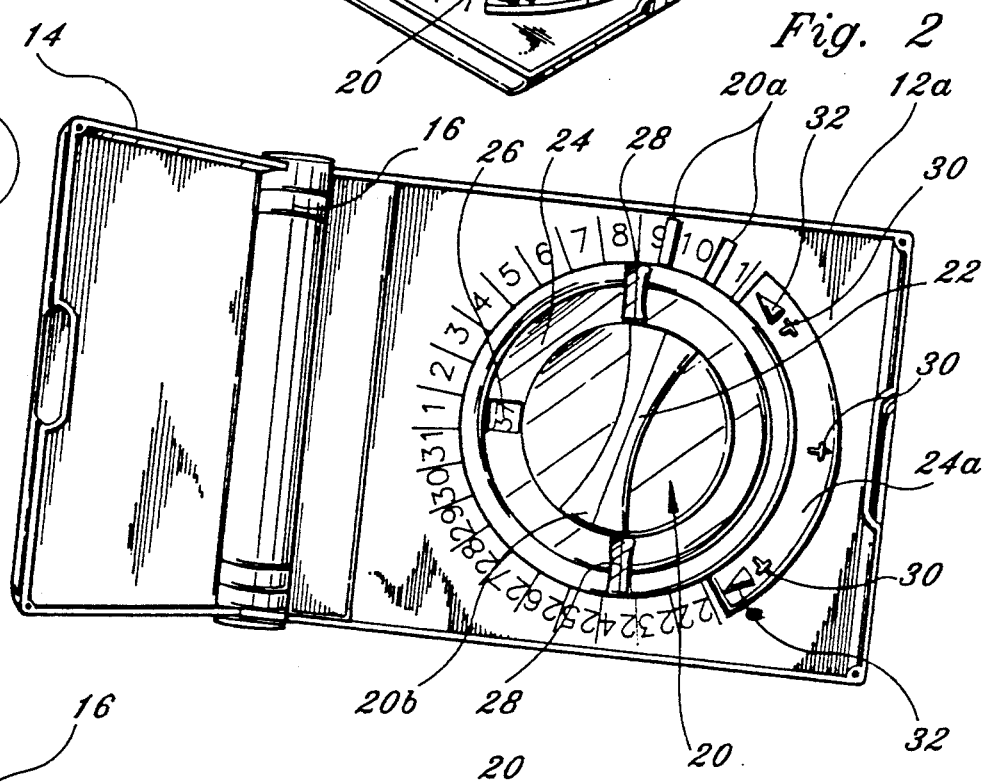
FIG. 2 is a top plan view of the invention shown in FIG. 1.

Referring now to FIG. 2 the inner disk contains a straight indicia marking 22 which could be a red line that is physically attached to guides 20*a* which can also include red markings. The guides 20*a* are spaced apart to physically encompass a single date (day of the month) number of indicia disposed on floor 12*a*. The outer disk 24 includes a window 26 which also displays a single number that represents the average number of days of the menstrual cycle of the user and is preselected by the user. An arc-shaped circumferential portion with the outer disk 24 includes segment 24*a* that extends beyond the circumference of the outer disk in a limited arc portion that acts to cover certain numbers representing the days of the month. Disposed on the arc portion 24*a* are universal symbols 30 which could represent babies and arrow heads 32. The outer ring also includes a pair of ridges 28 which are axially aligned for manually moving and rotating the outer disk.

Figure 3:
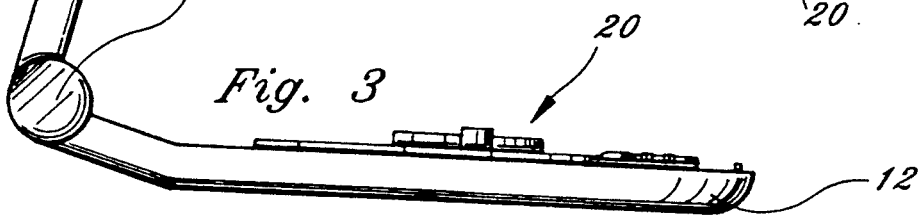
FIG. 3 is a side elevational view of the invention shown in FIG. 1.

FIG. 3 shows a side elevational view of the invention including case wall 14, hinge 16 and the side 12 containing the operating mechanism including inner ring 20.

Figure 4:
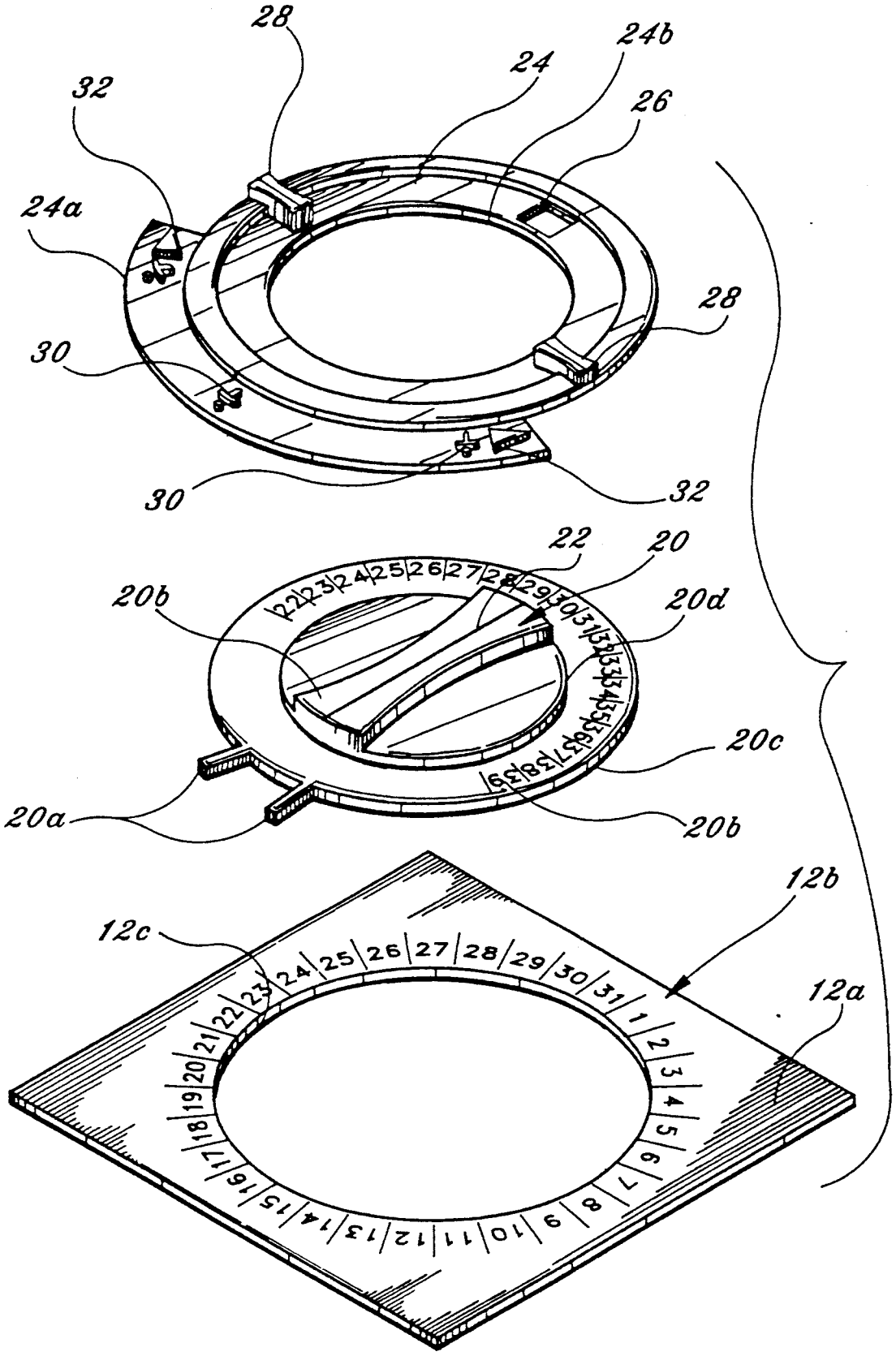
FIG. 4 is an exploded view of the operating mechanism of the present invention in perspective.

Referring now to FIG. 4 the actuating portion of the invention is shown. The floor 12*a* which is cut away for the sake of this description and is mounted in surface 12. The floor 12*a* is a flat portion having a recessed inner circular ring 12*c*. Disposed around the circumference of the recessed portion 12*c* are numerical indicia, equally spaced, representing numerically at 12*b* the 31 days of the month, separated by radially disposed lines.

The inner disk 20 is a rigid plastic shaped member that includes a raised ridge extending diametrically across the device 20*a* that includes an indicia straight line 22 which may be a red line. The circumference of the inner disk 20 includes numerical indicia as shown beginning with the number 22 and ending with the number 39 that are equally spaced and represent the average number of days in the user's menstrual cycle. These numbers 20*b* are disposed around the periphery of the inner disk 20 near the edge lip 20*c* which fits perfectly into recess 12*c*. Indentations and snaps can be provided to hold the disk 20 into the recess of 12*c* in floor 12*a*. Once the disk is in place as shown in FIG. 1, disk 20 can be manually rotated 360° around so that protruding guides 22*a* which also include highlight indicia such as red markings can be manually disposed so that a particular day of the month represented by indicia 12*b* can be selected between the guides 22*a*.

The upper outer ring 24 includes a pair of raised ridge 28 which are aligned linearly and include a different highlight indicia such as white lines. The outer ring 24 is sized so that the opening formed by outer ring 24*b* fits snugly and rotatably over disk 20 along recess 20*d* so that the outer ring 24 can be rotated by ridges 28 manually relative to each other. The outer ring 24 also includes window 26 that is sized to permit the display of only one number in the day of menstrual cycle length 20*b* indicia disposed on the inner disk. The outer ring 24 also includes an enlarged circumferential arc area 24*a* that is sized to block out when the ring is in place a selected segment of days of the month as displayed by indicia 12*b* on floor 12*a*. Also disposed on the arc portion 24*a* are arrows 32 and universal symbols representing babies 30. The baby symbols are on the segment that blocks out visually certain numerical days of the months.

To operate the device we refer back to FIG. 2 so that the user first manipulates inner ring 20 by moving the handle 20*b* so that the guide members 20*a* select the actual day of the month by numerals in which the user's first menstrual period begins. As shown in FIG. 2 the tenth day of the month would be the beginning of the user's menstrual period. Next the user would grasp ridges 28 and rotatably move the outer ring display window 26 to select the number of average days in the user's menstrual cycle. In this simple two-step process the job is done. The arc portion would then be moved depending on where the window selects the average number of days in a woman's menstrual cycle blocking out those days of the month during which conception is most likely. It is clearly shown between the arrows 32 on arc portion 24*a* and illustrated by the symbols for babies 30 disposed thereon.

The highlighted indicia such as red line 22 and red indicia on guides 24*a* to select the day or the month, quickly and clearly allow for the first selection of the inner ring and the day of the month. The white indicia on ridges 28 clearly allow for movement and the window presentation 26 easily and quickly. By providing a compact storage device, once the device has been actuated for the particular month, it can be safely stored and resist any type of accidental movement in the stored compact device.

Because of the simple nature and use of the device it is believed that the fertility period calculator shown in the present invention can be distributed for long term use especially in third world countries at low cost and the use of the device can be quickly taught to women in third world countries in spite of the reduced literacy rates in these countries. This invention is a low cost natural approach that could reduce greatly the overwhelming rapid population growth in many third world areas where there are objectives in reducing the unchecked population growth.

The instant invention has been shown and described herein in what it is considered to be the most practical and preferred embodiment It is recognized, however, that departures may be made therefrom within the scope of the invention and that obvious modifications will occur to a person skilled in the art.

What I claim is:

1. A fertility period calculator comprising:

a flat rigid planar, thin, hand-sized member having an annular aperture centrally disposed therethrough, a plurality of numerical indicia equally surrounding a perimeter of said annular aperture having the numerals 1 through 31 representing the days of the month;

a circular disk having an annular lip sized and rotatably mounted in said annular aperture portion of said flat member, said circular disk including a central upper handles means having an alignment indicia disposed thereon, and a pair of identifying probes, spaced apart, extending radially beyond a circumference of said disk, the space between the probes sized to encompass only one numeral at a time of the total numerals surrounding the perimeter of said planar member aperture, said probes highlighting the actual day of the month, said probes aligned to move relative to said member indicia; said disk including numerical indicia substantially relating to the total number of days within a single average menstrual cycle from 22 to 39 displayed around a predetermined portion of said disk; and a ring rotatably mounted on top of and engaged with said disk, said ring including a circumferential portion extending radially inward that covers the numerical indicia displayed around said disk relating to the menstrual cycle total days and an observation window, said window sized to view one number of the menstrual cycle total days, said ring having an enlarged circumferential arc area extending radially outward over a segment of the numerical indicia surrounding said annular aperture, thereby covering particular days of the month when conception is most likely to occur.

2. A fertility period calculator as in claim 1, including a rigid cover hingedly connected to one side of said planar member and sized to fit over said planar member in a closed position.

* * * * *